United States Patent [19]

Cunningham

[11] Patent Number: 5,005,599

[45] Date of Patent: Apr. 9, 1991

[54] RISING BRACE FOR INVALID WALKER, AND METHOD

[76] Inventor: Thomas W. Cunningham, 3580 Emerywood La., Orlando, Fla. 32812

[21] Appl. No.: 522,685

[22] Filed: May 14, 1990

[51] Int. Cl.[5] ..... A61H 3/00

[52] U.S. Cl. ..... 135/67; 135/72; 297/422

[58] Field of Search ..... 135/65-67, 135/71, 72, 74, 76; 272/70; 297/DIG. 10, 422, 183, 414

[56] References Cited

U.S. PATENT DOCUMENTS

| | | | |
|---|---|---|---|
| 2,556,121 | 6/1951 | Thomas | 272/70 X |
| 3,376,066 | 4/1968 | Kernes | 297/422 X |
| 3,708,182 | 1/1973 | Markiel | 297/DIG. 10 X |
| 4,231,614 | 11/1980 | Schaffer | 297/DIG. 10 X |
| 4,948,156 | 8/1990 | Fortner | 297/DIG. 10 X |

*Primary Examiner*—David A. Scherbel
*Assistant Examiner*—Lan Mai
*Attorney, Agent, or Firm*—Duckworth, Allen, Dyer & Doppelt

[57] ABSTRACT

A portable aid for assisting an invalid or elderly person in rising from a sitting position includes a portable vertical support and a brace member attached and stored with the portable vertical support. The brace member extends away from the vertical support and has a dimension in the horizontal direction sufficient to extend across the seat of the chair to permit a sitting person to push downwardly upon the brace member for assistance in rising to a standing position.

19 Claims, 2 Drawing Sheets

RISING BRACE FOR INVALID WALKER, AND METHOD

BACKGROUND OF THE INVENTION

1. Field of the Invention

The present invention relates generally to supports for invalids, and in particular relates to apparatus and methods designed to assist invalids and the elderly in rising to a standing position.

2. Description of the Prior Art

The term "walker" refers to a class of portable assist devices which enable an invalid or an elderly person to walk about. Typically, a Walker comprises a frame including generally two pairs of upright, generally vertical legs. Each pair of legs generally has a lower supporting brace member, the two pairs being joined together by a horizontal strut. Typically, a walker is made from lightweight aluminum tubing, and the legs may be telescopic and the entire structure collapsible to provide ease in storage. In use, an invalid or elderly person holds the upper supports, and after taking a step or two, lifts the walker and moves it forwardly so that the next steps may be taken.

When rising from a sitting position, elderly or invalid persons often find it quite difficult to move to a standing position. If a walker is used to pull into the standing position, frequently the walker tends to pivot about the lower end portion of its rear legs. This results in the person experiencing difficulty in rising to the standing position, and often causes instability which may result in the person falling or becoming injured. The problem of instability is described in U.S. Pat. No. 3,085,258 to Wolferts, and is also recognized in U.S. Pat. No. 4,474,202 to Blachner. See also U.S. Pat. No. 3,668,723 to Bratton.

Other patents of interest include the following: U.S. Pat. No. 421,529 to Vestal; U.S. Pat. No. 3,553,746 to Seiger; U.S. Pat. No. 4,314,576 to McGee; U.S. Pat. No. 4,212,493 to Ledesky; and U.S. Pat. No. 3,591,874 to O'Kennedy.

SUMMARY OF THE INVENTION

The present invention comprises both apparatus and an associated method for enabling an invalid or elderly person to rise unassisted from a sitting position in a chair or the like into the standing position. Specifically, the method of the present invention contemplates providing a portable, generally vertical support having a brace member attached with, and extensible generally horizontally away from the vertical support, positioning the vertical support in front of the sitting person, extending the brace member horizontally across the seat of the chair in which the person is sitting and permitting the person to rise to the vertical support by pushing downwardly against the brace member. Thereafter, the brace member is stored with the vertical support, so that the invalid or elderly person may carry the brace member in a portable manner with the vertical support itself.

The portable aid for assisting an invalid or elderly person in accordance with the present invention includes both the portable vertical support and the brace member attached with, and carried by the vertical support, the brace member extensible away from the vertical support and having a dimension in the horizontal direction sufficient to extend across the seat of a chair and also having a sufficient dimension in the vertical direction to permit a sitting person to push downwardly upon the brace member for assistance in rising to a standing position.

In a preferred embodiment, the brace member comprises a pair of spaced, generally horizontal rods, each having a proximal end adjacent the portable vertical support and also having a distal end. Means are provided for attaching the proximal ends to the portable vertical support, with at least one generally vertical support strut extending between the two spaced horizontal rods of the brace member.

It is also preferred that the brace member be stored with the vertical support, so that the brace member may be carried with the vertical support and available to the invalid or elderly person as required. In one specific embodiment, the vertical support comprises a walker having two pairs of generally vertical supports, with each pair of vertical supports forming a side of the walker, and with a generally horizontal hand hold reaching between the two vertical supports in each pair. The walker is provided with a generally horizontal strut connecting the two pairs of vertical supports, with the walker in accordance with the present invention being provided with two brace members, each brace member attached with one pair of the vertical supports and dimensioned to extend across the seat of a chair in order to permit a sitting person to push downwardly upon one or both brace members for assistance in rising to a standing position. Conventionally, the walker includes a lower, generally horizontal support expending between the two vertical supports of each pair, and in accordance with the present invention each of the base members comprises means for storing along that lower horizontal support. As described above, the preferred embodiment of the brace member comprises a pair of spaced horizontal rods, and in order to achieve the desired storage, the lower rod is provided with means for mating with the horizontal support of the corresponding walker vertical support pair.

THE DRAWINGS

FIG. 1 a perspective view illustrating the manner in which a walker in accordance with the present invention is utilized with a chair upon which an invalid or an elderly person is sitting.

DETAILED DESCRIPTION

A detailed description of a preferred embodiment of the present invention will now be described with reference to FIGS. 1–4.

Figure 1:
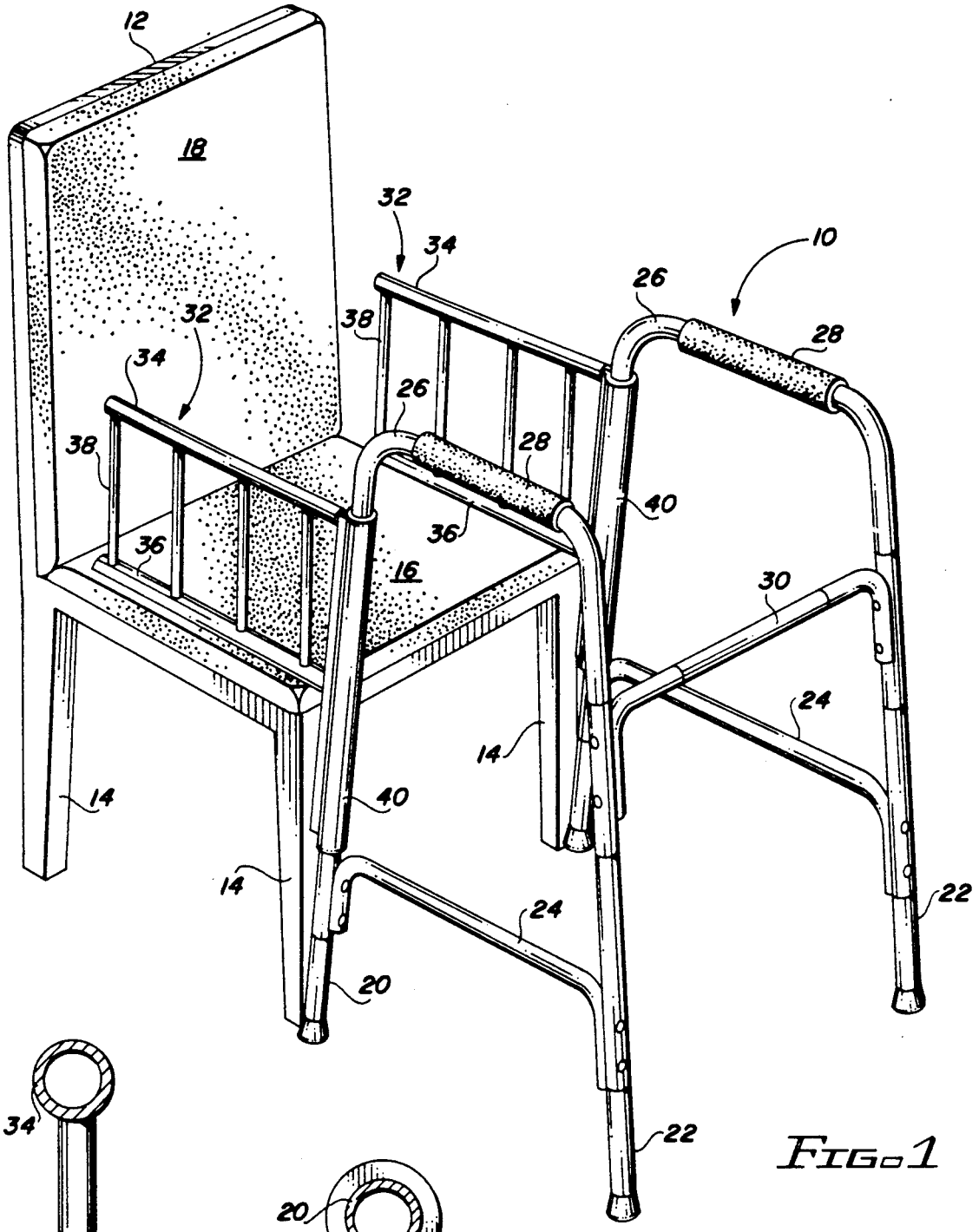
Figure 2:
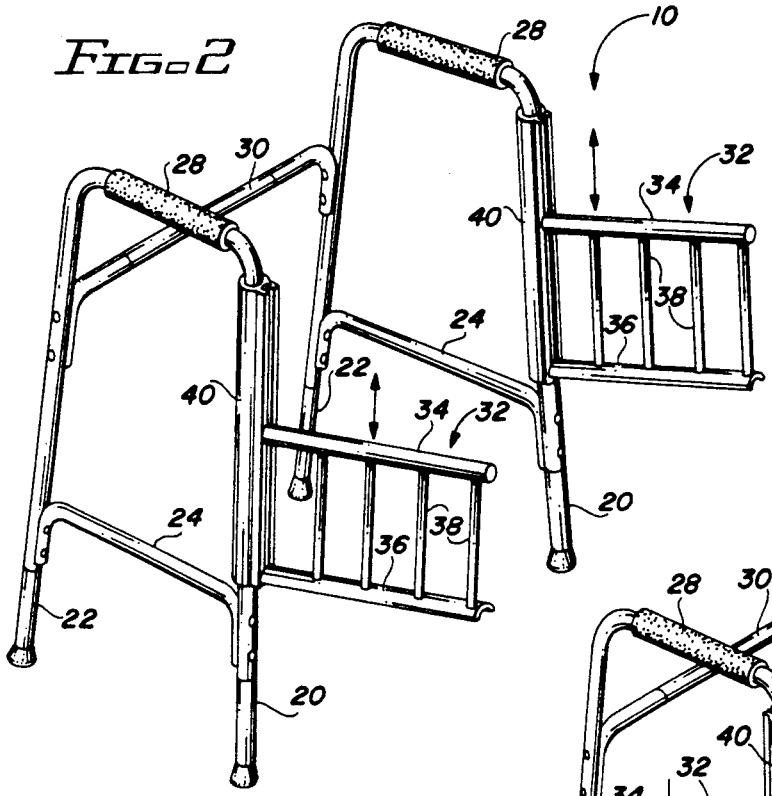
FIGS. 2 and 3 are perspective views illustrating the open and storage positions, respectively, of the brace members used with a walker in accordance with the present invention.
Figure 3:
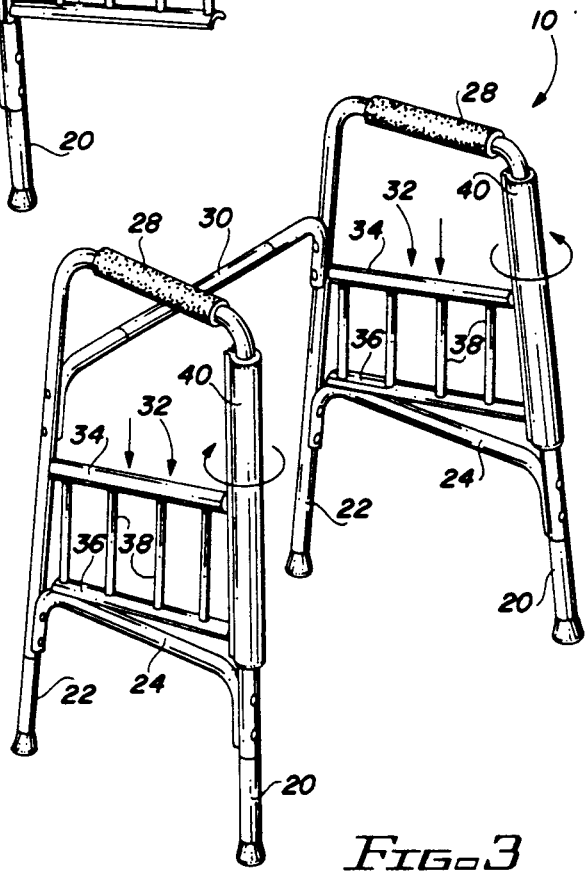

In FIGS. 1–3, reference numeral 10 refers generally to a walker in accordance with the present invention. In FIG. 1, the walker 10 is shown associated with a chair 12 having legs 14, seat 16 and back 18 in which a person who is to use the walker 10 may be sitting.

The walker 10 is provided with two pairs of vertical supports, each pair having two legs 20, 22 separated and rigidly constructed with a lower support 24 and an upper bridging hand hold 26. Typically, a hand grip 28 is positioned across the upper hand hold 26. Conventionally, the two pairs of vertical supports 20, 22 are joined by a horizontal strut 30, which may be provided with some mechanism (not shown) for permitting the two pairs of vertical supports to collapse for storage purposes.

In accordance with the present invention, the walker 10 is provided with two brace members 32, each of which is dimensioned to extend across the surface of the seat 16 of the chair 12, and which has a vertical dimension sufficient to permit a person sitting upon the chair to use the brace members to rise to a standing position. The braces 32 each consist of a pair of horizontal rods 34, 36 each of which rods are joined to a pivot mechanism 40 attached along one of the corresponding vertical supports 20 of each respective pair. One or more vertical struts 38 are fastened between the upper and lower horizontal rods 34, 36 of each brace 32. It will be appreciated that the construction and dimension of the brace members 32 is such as to permit an elderly or invalid person sitting upon the chair 12 to push downwardly across the upper rod 34 of each brace 32, without causing the walker 10 to tip over, and thus permit the person rising to step into the area of the walker.

Figure 6:
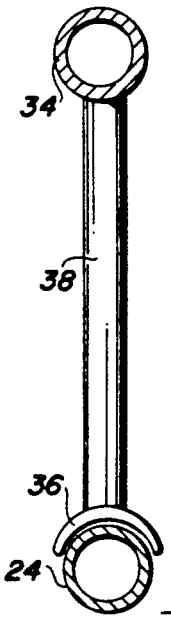
FIG. 6 is a cross-sectional elevation of a portion of the walker shown in FIGS. 1–5, illustrating the manner in which the base member is stored along a corresponding horizontal support.
Figure 5:
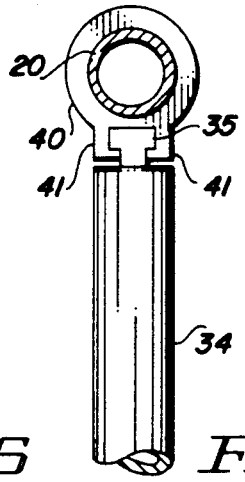
FIGS. 4 and 5 are partial perspective and cross-sectional views, respectively, of a portion of the walker and brace member arrangement of FIGS. 1–3.
Figure 4:
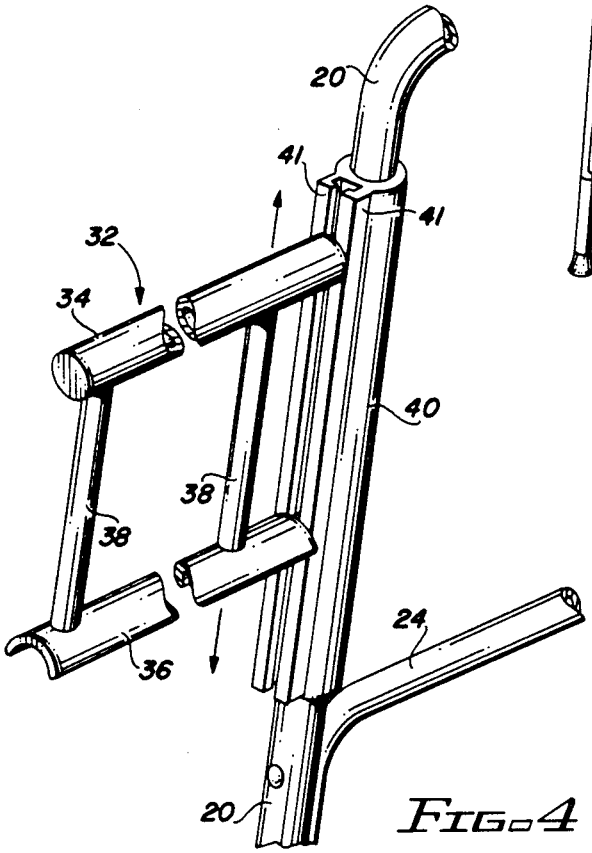

As shown in FIGS. 2, 4 and 5, the brace members 32 are easily moved up and down the vertical support 20 in the rotatable support 40 by virtue of the flanged faces 41 of the vertical support 40. After use in the manner shown in FIG. 1, the brace members 32 may be moved in a downward direction along the respective vertical support 20, and then rotated into a storage position (note FIG. 3) along the horizontal support 24. To this end, the lower rod 36 of each brace member 32 has a mating configuration to receive the horizontal support 24 (note FIG. 6). In this way, each brace member 32 may be stored within the plane of each corresponding pair of vertical supports in a facile manner by the invalid or elderly person using the walker 10.

It will of course be understood by those skilled in the art that a number of modifications and changes may be made in the construction of the vertical supports and the brace member without departing from the spirit and scope of this invention. For example, the brace members may be stored under the arm rest of a wheel chair, and be rotated outwardly as required to permit an elderly person sitting upon a chair to first rise and then sit in the wheel chair, with subsequent storage of the brace members in a manner similar to that described above.

What is claimed is:

1. A method for enabling an invalid or an elderly person to raise unassisted from a sitting position in a seat or the like and into a standing position, comprising the steps of:

providing a portable, generally vertical support having a brace member attached with, and extensible generally horizontally away from the vertical support, the brace member having a sufficient vertical dimension to provide substantial assistance in rising to a person sitting in the seat;

positioning the vertical support in front of the sitting person; and thereafter extending the brace member horizontally across the surface of the seat and in contact with the seat in which the person is sitting so as to permit the person to rise to the vertical support by pushing downwardly against the top of the brace member.

2. The method recited in claim 1 further comprising the step of slideably adjusting the vertical height of the brace member along the vertical support.

3. The method recited in claim 1, further comprising the step of storing the brace member with the vertical support.

4. The method recited in claim 1 wherein the portable vertical support comprises two spaced, generally vertical rods and wherein the storing step comprises fastening the brace member between the two vertical rods.

5. A portable aid for assisting an invalid or elderly person in rising from a sitting position in a seat to a standing position, comprising a portable vertical support and a brace member attachable with the vertical support, the brace member extensible away from the vertical support and having a dimension in the horizontal direction sufficient to extend across the surface of the seat and in contact with the seat and a sufficient dimension in the vertical direction to permit a sitting person to push downwardly upon the brace member for assistance in rising to a standing position.

6. The portable aid recited in claim 5 further comprising means for slideably adjusting the vertical height of the brace member along the vertical support.

7. The portable aid recited in claim 5 further comprising means for storing the brace member with the vertical support.

8. A portable aid as recited in claim 7 wherein the vertical support comprises two spaced, generally vertical rods and the storing means comprises means for fastening the brace member between the two vertical rods.

9. The portable aid recited in claim 8 further comprising a horizontal support between the spaced vertical rods, the storing means comprising means for storing the brace member along the horizontal support.

10. The portable aid recited in claim 9 wherein the means for storing the brace member along the horizontal support comprises means for fitting the brace member to the horizontal support in a mating relationship.

11. The portable aid recited in claim 5 further comprising means for releasably attaching the brace member with the vertical support.

12. A portable aid for assisting an invalid or elderly person in rising from a sitting position in a chair to a standing position, comprising:

a portable vertical support and a brace member attachable with the vertical support, the brace member extensible away from the vertical support and having a dimension in the horizontal direction sufficient to extend across the surface of the seat and in contact with the seat of the chair and a sufficient dimension in the vertical direction to permit a sitting person to push downwardly upon the brace member for assistance in rising to a standing position, wherein the brace member comprises, a pair of spaced, generally horizontal rods each having a proximal end adjacent the portable vertical support and a distal end;

means attaching the proximal ends of the horizontal rods with the portable vertical support; and at least one generally vertically support strut extending between the two spaced horizontal rods toward the distal end.

13. The portable aid recited in claim 12, wherein the attaching means comprises means permitting the vertical sliding of the brace member along the portable vertical support member.

14. A portable aid for assisting an invalid or elderly person in rising from a sitting position in a chair to a standing position, comprising:

a portable vertical support and a brace member attachable with the vertical support, the brace member extensible away from the vertical support and having a dimension in the horizontal direction sufficient to extend across the surface of the seat and in contact with the seat of the chair and a sufficient dimension in the vertical direction to permit a sitting person to push downwardly upon the brace member for assistance in rising to a standing position; wherein the brace member comprises;

a pair of spaced, generally horizontal rods each having a proximal end adjacent the portable vertical support and a distal end;

means attaching the proximal ends of the horizontal rods with the portable vertical support;

at least one generally vertically support strut extending between the two spaced horizontal rods toward the distal end; and wherein the portable vertical support comprises a pair of spaced, generally vertical rods with the attaching means further comprising means for rotating the brace member to a storage position between the two vertical rods.

15. A walker for an invalid or elderly person, comprising:

two pairs of generally vertical supports, each pair of vertical supports forming a side of a walker, with an upper generally horizontal hand hold reaching between the two vertical supports in each pair;

a generally horizontal strut connection the two pairs of vertical supports;

two brace members, each brace member attached with one pair of vertical supports and dimensioned to extend across the surface of the seat and in contact with the seat of a chair in order to permit a sitting person to push downwardly upon one or both brace members for assistance in rising to a standing position; and means for storing each brace member between the pair of vertical supports with which each brace member is attached.

16. The walker recited in claim 15 wherein each pair of vertical supports further comprises a lower, generally horizontal support and wherein the storing means comprises means for storing the brace member along the lower horizontal support.

17. The walker recited in claim 16 wherein the storing means further comprises means for fitting the brace member to the lower horizontal support in a mating relationship.

18. The walker recited in claim 15 wherein each brace member comprises;

a pair of spaced, generally horizontal rods each having a proximal end adjacent to the one of the vertical supports with which the brace member is attached, and a distal end;

means attaching the proximal ends of each brace member with the one portable vertical support in the pair with which the brace member is attached; and vertical support means between the spaced, generally horizontal rods of each brace member.

19. The walker recited in claim 15 further comprising means permitting the vertical sliding of each brace member along the vertical support member to which each brace member is attached.

* * * * *